US006183074B1

(12) United States Patent
Miyashita et al.

(10) Patent No.: US 6,183,074 B1
(45) Date of Patent: Feb. 6, 2001

(54) INK-JET PRINTING APPARATUS

(75) Inventors: Yoshiko Miyashita, Kawasaki; Tokihide Ebata; Makoto Aoki, both of Yokohama; Chikanobu Ikeda, Tokyo, all of (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 09/351,917

(22) Filed: Jul. 14, 1999

Related U.S. Application Data

(62) Division of application No. 08/632,159, filed on Apr. 15, 1996, now Pat. No. 5,963,236.

(30) Foreign Application Priority Data

Apr. 17, 1995 (JP) ..... 7-090896

(51) Int. Cl.[7] ..... B41J 2/175
(52) U.S. Cl. ..... 347/85
(58) Field of Search ..... 347/84, 85, 86, 347/87; 137/177, 178

(56) References Cited

U.S. PATENT DOCUMENTS

| | | | |
|---|---|---|---|
| 4,337,469 | 6/1982 | Takano et al. . | |
| 4,814,786 | 3/1989 | Hoisington et al. . | |
| 4,929,963 | 5/1990 | Balazar . | |
| 5,280,300 | 1/1994 | Fong et al. | 347/87 |
| 5,650,811 * | 7/1997 | Seccombe et al. | 347/85 |

FOREIGN PATENT DOCUMENTS

| | | |
|---|---|---|
| 0 532 300 | 3/1993 | (EP) . |
| 0 589 540 | 3/1994 | (EP) . |
| 0 603 515 | 6/1994 | (EP) . |
| 61-37438 | 2/1985 | (JP) . |
| 61-57342 | 3/1986 | (JP) . |
| 1-76237 | 5/1989 | (JP) . |
| 3-16737 | 1/1991 | (JP) . |
| 5-201022 | 8/1993 | (JP) . |
| 6-27146 | 4/1994 | (JP) . |
| 6-340087 | 12/1994 | (JP) . |
| 7-60977 | 3/1995 | (JP) . |
| 7-68773 | 3/1995 | (JP) . |
| 7-76098 | 6/1995 | (JP) . |

* cited by examiner

*Primary Examiner*—N. Le
*Assistant Examiner*—Judy Nguyen
(74) *Attorney, Agent, or Firm*—Fitzpatrick, Cella, Harper & Scinto

(57) ABSTRACT

An ink-jet printing apparatus restricts fluctuation of the printing density due to coagulation and settling of a coloring agent in a water based ink, in which a water insoluble coloring agent or a coloring agent having low water solubility is dispersed. By this, movement of the ink caused due to difference of specific gravity caused by coagulation of the coloring agent or so forth in an upper passage to a lower passage can be restricted to successfully prevent increasing of difference of ink density.

3 Claims, 16 Drawing Sheets

FIG. 8B
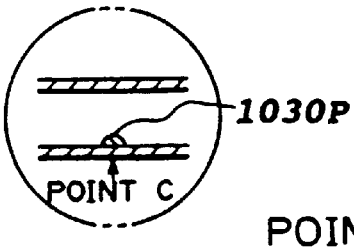
FIG. 8C
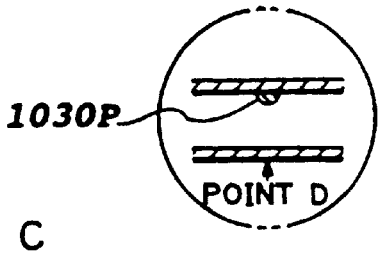
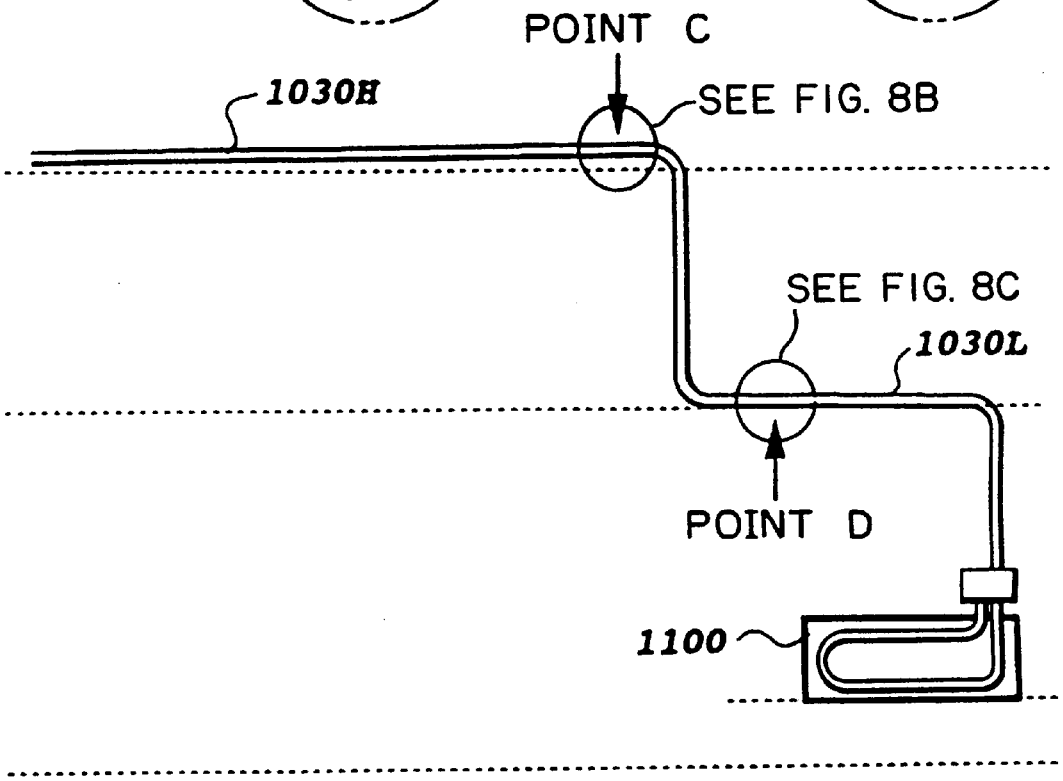
FIG. 8A

INK-JET PRINTING APPARATUS

This application is a divisional application of U.S. application Ser. No. 08/632,159 filed Sep. 15, 1996 is now U.S. Pat. No. 5,963,236.

BACKGROUND OF THE INVENTION

1. Field of the Invention

The present invention relates generally to an ink-jet printing apparatus for performing predetermined printing operation by ejecting an ink toward a various printing medium such as paper, cloth, non-woven fabric, OHP sheet and so forth, and more particularly to an ink-jet printing apparatus for performing printing operation employing an ink containing a coloring agent which is water insoluble or has low solubility to water.

2. Description of the Related Art

As typical method for performing printing on cloth, wallcovering and so forth, a screen textile printing method to perform direct printing on cloth and so forth by employing a silk screen printing plate. In this method, with respect to an original image, at first, the silk screen printing plates are prepared for respective colors used in the original image. Then, the silk screen printing plate is loaded on a screen textile printing apparatus to perform printing by directly transferring the ink to the cloth or so forth through mesh of the silk screen printing plate.

However, in such screen textile printing method, a huge amount of process steps and working days are required for preliminarily preparing the silk screen printing plates. Further operation is required for blending of inks for respective colors, and registering of the silk screen printing plate per each color. In addition, since the printing apparatus per se is bulky, and the size of the apparatus is increased in proportion to number of colors to be used to require substantial space for installation. Also, a space for storing the silk screen printing plates becomes necessary.

Therefore, it has been proposed an ink-jet printing method to perform printing directly on a printing medium, such as the cloth, wallcovering and so forth. The ink-jet printing method is to eject fine ink droplet through ejection ports of the ink-jet head for performing printing image or so forth by forming ink dots on the printing medium such as the cloth, which does not require the screen printing plate which has been required in the conventional screen textile printing to significantly shorten the process steps and working days for forming the image on the cloth. Furthermore, the ink-jet textile printing method is advantageous for capability of down-sizing of the apparatus. In addition, since printing information for printing can be stored in various storage medium, such as tape, flexible disk, optical disk and so forth, the ink-jet textile printing system is superior in safekeeping and storage of the printing information. Furthermore, the ink-jet textile printing method is advantageous in easiness of processing of the printing information, such as changing of color, layout and so forth, of expansion and contraction of the image and so forth.

On the other hand, cloth as printing medium to be employed in ink-jet textile printing, extends in wide variety, such as natural fibers, e.g. cotton, silk, wool and so forth, synthetic fibers, e.g. nylon, rayon, polyester and so forth, mixed fabric of these fibers and so forth. Accordingly, in order to satisfactorily perform printing for cloth consisted of such wide variety of fibers, it is desirable to adapt dyes of the ink to the material fibers. For example, disperse dye is preferred for polyester fiber, metal complex salt dye is preferred for wool, vat dye or pigment is preferred for cotton. Amongst, disperse dye, metal complex dye, vat dye and pigment are known as water insoluble coloring agent or coloring agent having low solubility.

In order to prepare water based ink employing water insoluble dye or dye having low solubility, it is typically performed to prepare fine particle of material of dye and disperse the fine particle dye material into water by dispersing agent for emulsification. However, when the water based ink, in which the dispersing agent is dispersed and emulsified, coagulation and settling out of the dye in the ink can occur with time to cause variation of dye density resulting in fluctuation of printing density.

With respect to such problem of degradation of the printing quality, there has been proposed in Japanese Patent Application Laid-open No. 57342/1986 to provide a function of stirring the ink in an ink transporting passage from an ink storage portion to an ink ejection port of an ink-jet head.

However, the construction of the prior art proposed in the above-identified publication can be insufficient for satisfactorily using the water based ink employing the water insoluble dye or dye having low solubility.

Namely, fluctuation of density of the coloring agent due to coagulation and so forth is significant in the ink storage portion having relatively large ink storage capacity, in the ink transporting passage. Thus, it is typical to provide the ink stirring function in the ink storage portion. However, coagulation of the coloring agent and so forth may be caused in other portions, such as in a tube to be normally used as supply passage for the ink. Difference of density due to coagulation of the coloring agent or so forth should cause difference of specific gravity which causes motion depending upon position of the vertical position of the tube to further increase density difference. On the other hand, rubber and resin type tubes are frequently employed as the supply passage of the ink. Such tubes have a tendency to cause settlement or absorption of the coloring agent. It is considered that owing to property of the material of the tube, the coloring agent tends to be absorbed on a wall within the tube. When such tube is employed, particularly, in case of not used for a long period, even with small difference of positional relationship between vertical direction, motion of the coloring agent is caused to make density difference significant.

FIGS. 1A to 1D are diagrammatic views for explaining fluctuation of density in the tube, respectively.

Water based ink consisted of water insoluble coloring agent or coloring agent having low solubility, filled in the tube, has uniform density as initially filled, as shown in FIG. 1A. In the condition of being left in non-use, such as not performing printing, coagulation and settlement may be caused in the ink during this period to cause small density difference as shown in FIG. 1B.

On the other hand, if such small density distribution is caused in the portion of the tube having height difference as shown in FIG. 1C, the portion of the ink having low specific gravity moves upwardly and the portion of the ink having high specific gravity moves downwardly as shown in FIG. 1D. By this movement, density difference within the tube is promoted.

However, despite of the fact of presence of density fluctuation, the ink stirring function is typically provided in the ink storage portion in the viewpoint of installation space. Accordingly, it has been difficult to solve the problem of fluctuation of the density of the coloring agent by stirring in the portion having small space, such as the tube.

On the other hand, in the ink-jet printing apparatus to be employed in printing press, textile printing and so forth, ink consuming amount is relatively large and ink consuming speed is relatively high. In case of such apparatus, it has been known to externally provide large capacity ink tank. When such construction is taken, the tube as the ink supply passage between the ink tank and the printing head becomes relatively long. Therefore, the ink amount in the tube is larger than that in the normal printer. On the other hand, it is practically not possible to maintain the ink supply passage completely horizontal. Therefore, it is inevitable to cause height difference in the tube positions. Accordingly, influence of the fluctuation of the density of the coloring agent caused in the tube for the printing density becomes significant in the ink-jet textile printing apparatus.

SUMMARY OF THE INVENTION

It is, therefore, an object of the present invention to enable to satisfactorily use an ink employing water insoluble coloring agent or coloring agent having low water solubility, as set forth above.

Another and more specific object of the present invention is to provide an ink-jet printing apparatus which can reduce fluctuation of printing density caused by coagulation of the coloring agent in the ink or so forth in the construction where a printing head and an ink storage portion are provided separately and a supply passage is provided therebetween.

In a first aspect of the present invention, there is provided an ink-jet printing apparatus for performing printing by ejecting an ink to a printing medium with employing a printing head for ejecting the ink, comprising:

an ink storage portion storing the ink;

an ink passage performing flow of the ink between the ink storage portion and an ink ejection opening of the printing head; and control means for controlling movement of a coloring agent of the ink in the ink passage.

The ink may be a water based ink, in which a water insoluble coloring agent or the coloring agent having low water solubility is dispersed.

The control means may control movement of the coloring agent of the ink by varying position in the vertical direction of the ink passage.

Variation of the position of the ink passage may form convex shaped configuration in the vertical direction.

Variation of the position of the ink passage may form a convex shaped configuration in the vertical direction, and a plurality of portions in the convex shaped configuration are formed in series.

Variation of the position of the ink passage may be caused by projection within the ink passage.

Variation of the position of the ink passage may be constructed by connecting different diameter of the ink passages.

Variation of position of the ink passage may be a step provided at a part of the ink passage.

Variation of position of the ink passage may be formed by bending of the ink passage.

Variation of position of the ink passage may be formed by deformation of the ink passage.

The control means may block the flow of the ink passage during non-printing state.

The control means may be constructed to divide the ink passage into a plurality of passages.

The projection may be provided on the lower surface of the ink passage at relatively high position in the vertical direction and on the upper surface of the ink passage at relatively low position in the vertical direction.

The step may be provided at a portion having relative height difference in the vertical direction.

Variation of position of the ink passage may be constructed with the portion having the vertical height greater than or equal to 1/10 times and smaller than or equal to 20 times of the inner diameter of the ink passage.

Variation of position of the ink passage may be constructed with the portion having the vertical height in a range greater than or equal to 1/10 times and smaller than or equal to 20 times of the inner diameter of the ink passage, and the interval in the horizontal direction is in a range greater than or equal to 5 times and smaller than or equal to 100 times of the inner diameter of the ink passage.

The ink passage may be the ink passage between the printing head and the ink storage portion.

A water based ink, in which a water insoluble coloring agent or the coloring agent having low water solubility may be dispersed, and having an ink storage portion, wherein the ink storage portion being a fixed type and having depth X, lateral width Y and height H expressed by:

$$X \times Y \leqq H^2.$$

In a second aspect of the present invention, there is provided an ink supply system for supplying an ink for a printing head of an ink-jet apparatus performing printing by ejecting the ink, comprising:

an ink storage portion storing the ink;

an ink passage performing flow of the ink between the ink storage portion and an ink ejection opening of the printing head; and control means for controlling movement of a coloring agent of the ink in the ink passage.

The ink may be a water based ink, in which a water insoluble coloring agent or the coloring agent having low water solubility is dispersed.

The control means may perform the control by varying position in the vertical direction of the ink passage.

Variation of the position of the ink passage may form convex shaped configuration in the vertical direction.

Variation of the position of the ink passage may form convex shaped configuration in the vertical direction, and a plurality of portions in the convex shaped configuration are formed in series.

Variation of the position of the ink passage may be caused by projection within the ink passage.

Variation of the position of the ink passage may be constructed by connecting different diameter of the ink passages.

Variation of position of the ink passage may be a step provided at a part of the ink passage.

Variation of position of the ink passage may be formed by bending of the ink passage.

Variation of position of the ink passage may be formed by deformation of the ink passage.

The control means may block the flow of the ink passage during non-printing state.

The control means may be constructed to divide the ink passage into a plurality of passages.

The projection may be provided on the lower surface of the ink passage at relatively high position in the vertical direction and on the upper surface of the ink passage at relatively low position in the vertical direction.

The step may be provided at a portion having relative height difference in the vertical direction.

Variation of position of the ink passage may be constructed with the portion having the vertical height greater than or equal to 1/10 times and smaller than or equal to 20 times of the inner diameter of the ink passage.

Variation of position of the ink passage may be constructed with the portion having the vertical height in a range greater than or equal to 1/10 times and smaller than or equal to 20 times of the inner diameter of the ink passage, and the interval in the horizontal direction is in a range greater than or equal to 5 times and smaller than or equal to 100 times of the inner diameter of the ink passage.

The ink passage may be the ink passage between the printing head and the ink storage portion.

Therefore, according to the present invention, in an ink-jet printing apparatus which performs printing by ejecting an ink toward a printing medium by means of a printing head ejecting the ink, includes an ink storage portion storing the ink, an ink passage for flowing the ink between the ink storage portion and an ink ejection opening of the printing head, and control means for controlling motion of the coloring agent of the ink in the ink passage.

Preferably, the ink is a water based ink, in which water insoluble coloring agent or coloring agent having low water solubility is dispersed.

The above and other objects, effects, features and advantages of the present invention will become more apparent from the following description of embodiments thereof taken in conjunction with the accompanying drawings.

BRIEF DESCRIPTION OF THE DRAWINGS

FIGS. 8A–8C are a diagrammatical view and enlargements thereof showing arrangement and construction of the tube according to the second embodiment of the invention;

DESCRIPTION OF THE PREFERRED EMBODIMENT

Figure 1A:
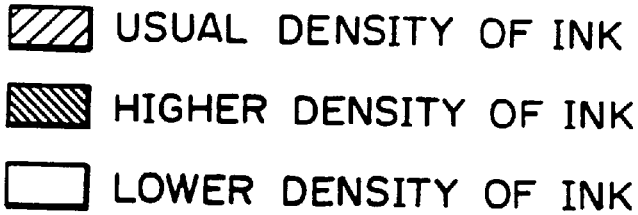
FIGS. 1A to 1D are conceptual views showing a manner of causing fluctuation of ink density in an ink employing preferably, the ink is a water based ink, in which water insoluble coloring agent or the coloring agent having low solubility.
Figure 1A:
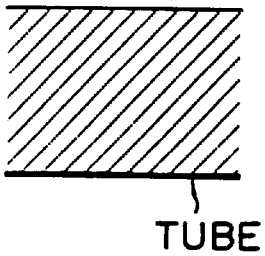
Figure 1B:
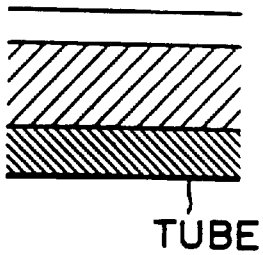
Figure 1C:
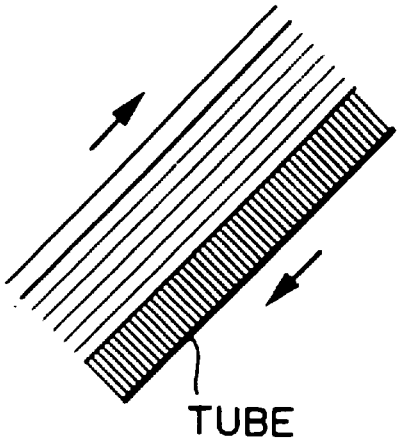
Figure 1D:
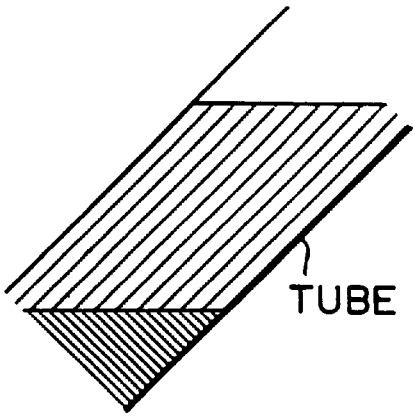
Figure 2:
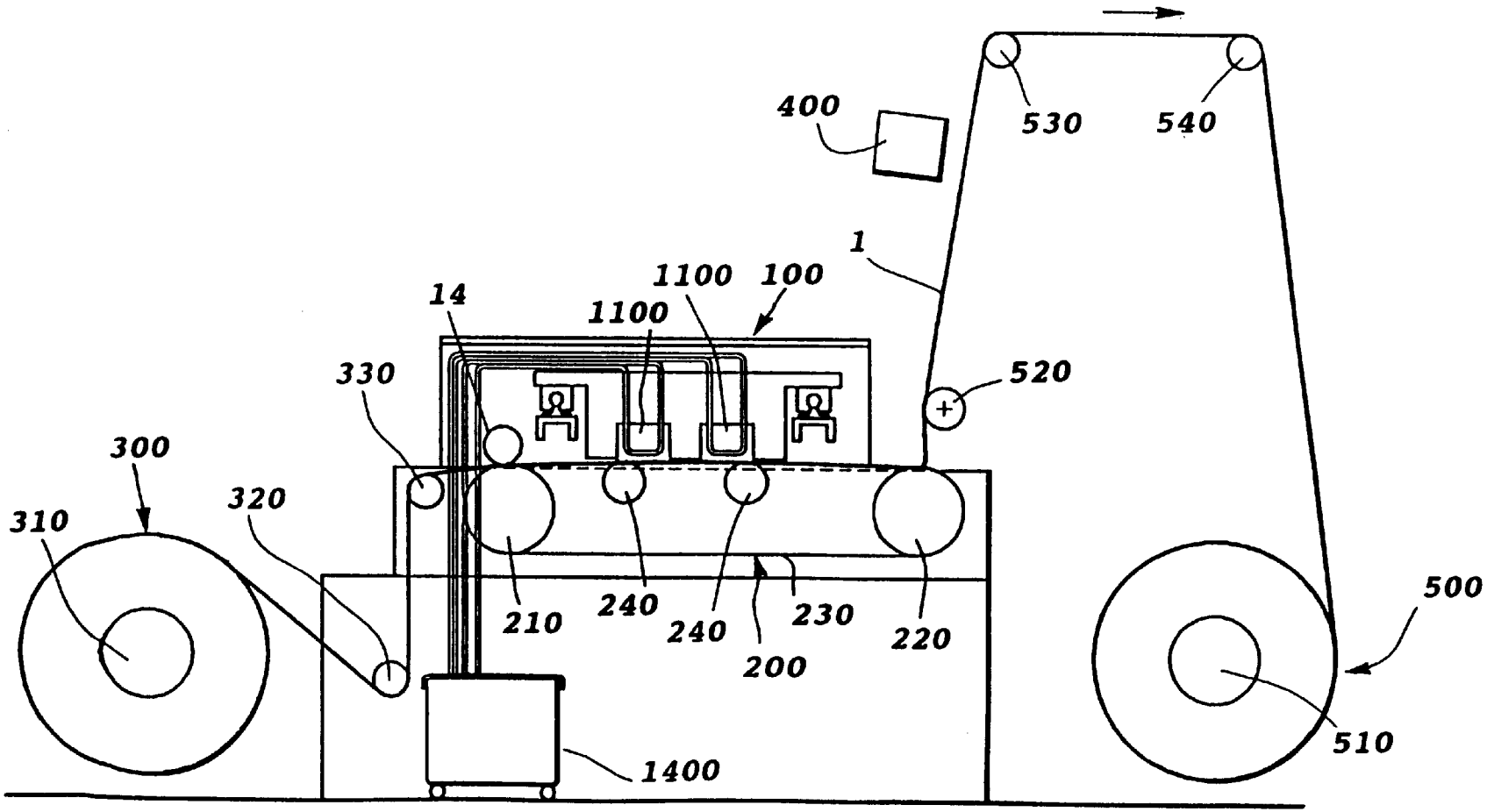
FIG. 2 is a diagrammatic cross-sectional view showing a general construction of one embodiment of an ink-jet textile printing apparatus according to the present invention.

FIG. 2 is a diagrammatic cross-sectional view showing general construction of an ink-jet textile printing apparatus as one embodiment of an ink-jet printing apparatus according to the present invention.

Here, 1 denotes a cloth as a printing medium, which is fed according to rotation of a feeding roller 510 and reaches a transporting portion 200 via intermediate rollers 520, 530 and 540. The transporting portion 200 is located in opposition to a printer portion 100 so that printing for the cloth 1 is performed while the later is transported in substantially horizontal direction by the transporting portion 200. After printing, the cloth 1 is taken up on a take-up roller 310 via intermediate rollers 330 and 320.

Figure 3:
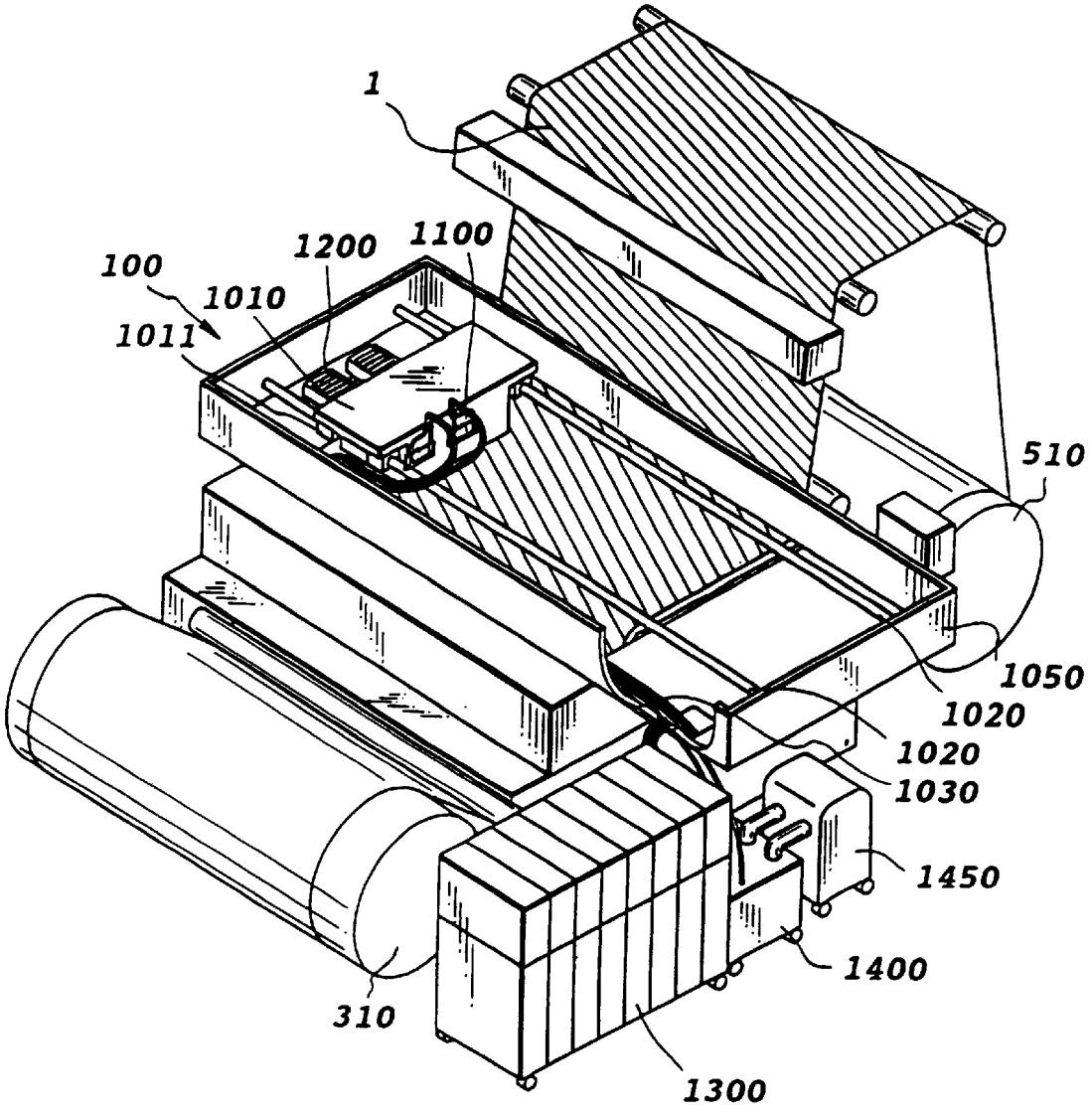
FIG. 3 is a schematic perspective view of the apparatus shown in FIG. 2.

FIG. 3 is a general perspective view mainly showing a printing portion 100 of the apparatus shown in FIG. 2. As shown in FIG. 3, in the printing portion 100, a pair of parallel guide rails 1020 are provided within a printing frame 1050 in the printing portion 100, which guide rails extend in a primary scanning direction perpendicular to a feeding direction of the cloth 1. On the guide rails 1020, a head carriage 1010 is mounted via a ball bearing 1011. The head carriage 1010 thus may reciprocally move in the primary scanning direction. The head carriage 1010 is driven by a driving motor (not shown) fixed on one side wall of the printing frame 1050, via a drive belt (not shown). On the other hand, on the inner lower surface of the head carriage 1010, a printing head unit (not shown) for performing printing on the cloth is mounted.

The printing head unit employs a plurality of printing heads 1100 for each ink to be used. Each printing head 1100 has a plurality of ink ejection openings aligned in parallel to the transporting direction of the printing medium. A plurality of sets of these printing heads are arranged in two stages along the transporting direction. The printing head 1100 generates bubbles in the ink by applying a thermal energy to the ink to eject the ink by generation of bubbles.

To the printing head, the ink of the corresponding color is supplied from a plurality of ink storage tank units 1300 via respective connection tubes 1030 as ink supply passage, as required. The detailed construction of the ink supply passage will be discussed later. Since these ink supply passages are moved in association with movement of the head carriage 1010, they are arranged in a caterpillar (not shown) for ease of movement and protection from breakage or damaging to be caused by movement. It is preferred, while not limitative, to form the tube as the ink supply passage, of rubber type material such as fluorocarbon rubber, isopropylene rubber, butyl rubber, natural rubber, silicon rubber and so forth, fluororesin type material such as teflon and so forth, plastic type material such as polyolefin, polyethylene, vinyl chloride and so forth.

On the other hand, a capping unit 1200 is provided at the lower portion of a home position located at the end of the range of shifting of the printing head unit. The capping unit 1200 has a cap member contacting to ejection opening forming surface of respective printing head 1100 while not printing. Upon non printing, each printing head 1100 is shifted to the home position as the position opposing to the capping unit 1200 for capping. When the printing head is left in the air for a long period, the ink is evaporated in the ejection opening to increase viscosity to make ejection unstable. In order to prevent this, the ejection port is shut off from the ambient air by capping. Within the capping member, a liquid absorbing material maintained in wet condition with the ink is provided. By this, the inside of the capping member is held in high humidity to minimize increase of viscosity of the ink.

Figure 4:
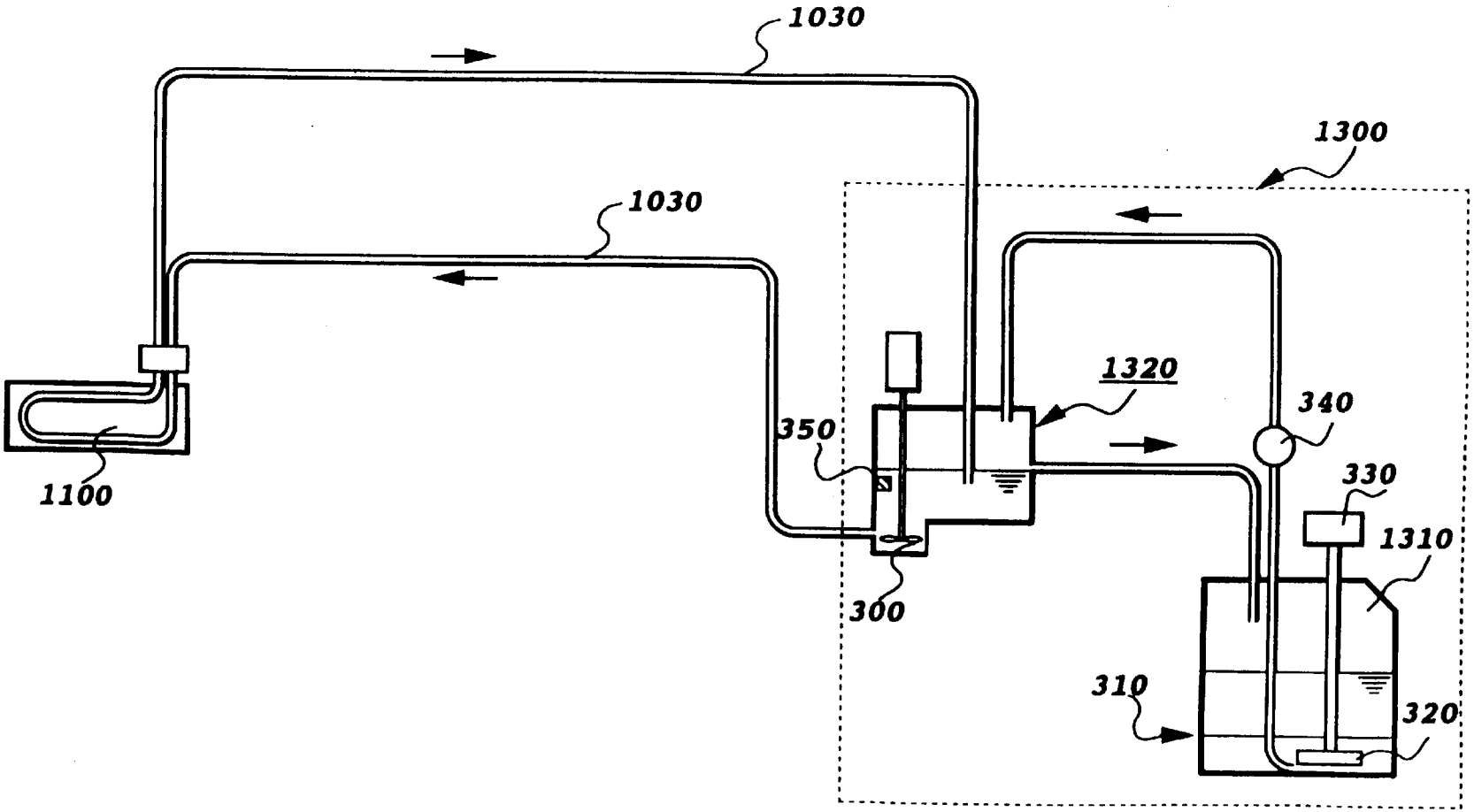
FIG. 4 is a diagrammatic view of an ink supply passage to be employed in the apparatus as shown in FIG. 2.

FIG. 4 is a diagrammatical view showing the ink supply passage in the apparatus. It should be noted that FIG. 4 shows an ink supply passage for one printing head, and, in practice, the ink supply passages are provided in number corresponding to number of the printing heads.

In the ink storage unit 1300, the reference numeral denotes a main tank storing a large amount of ink, 1320 denotes a sub-tank for maintaining water head difference to stabilize ejection, and 340 denotes a pump for supplying the ink of the main tank 1310 to the sub-tank 1320. On the other hand, respective components are connected to the ink supply tube 1030. In case of the above-mentioned construction, since the ink storage unit 1300 is provided outside of the main body of the textile printing apparatus, the length of the supply tube 1030 becomes relatively long. On the other hand, it is difficult to place the tube to the printing head 1100 completely horizontal with no difference of position in the vertical direction (height direction), in the tube construction.

Normally, ink supply to the printing head 1100 is performed automatically in response to ink ejecting operation from the printing head 1100 by capillary effect. On the other hand, ink supply to the sub-tank 1320 is performed by generating an alarm to the user in response to a detection signal from a sensor provided in the sub-tank 1320 to make the user to drive the pump 340.

In the main tank 1310, an ink stirring member 320 is provided to stir large amount of ink stored therein. Namely, in order to prevent the coloring agent of the ink in the tank from coagulating or settling off, the stirring member 320 is driven by the driving portion 330 at a predetermined timing to rotate to stir the ink.

Next, discussion will be given for the ink to be employed in the present embodiment. As the ink applicable for the present embodiment, an ink for ink-jet, in which water insoluble coloring agent or coloring agent having low water solubility is dispersed, can be considered. Here, the coloring agent means a material having a nature to give a color to the article. Here, disperse dye, metal complex dye, pigment and so forth may be used.

As disperse dyes,

C. I. disperse yellow 5, 42, 54, 64, 79, 82, 83, 93, 99, 100, 119, 122, 124, 126, 160, 184:1, 186, 198, 199, 204, 211, 224 and 237;

C. I. disperse orange 13, 29, 31:1, 33, 49, 54, 55, 66, 73, 118, 119 and 163;

C. I. disperse red 54, 72, 73, 86, 88, 91, 92, 93, 111, 126, 127, 134, 135, 143, 145, 152, 153, 154, 159, 164, 167:1, 177, 181, 204, 206, 207, 221, 239, 240, 258, 277, 278, 283, 288, 311, 323, 343, 348, 356 and 362;

C. I. disperse violet 33;

C. I. disperse blue 56, 60, 73, 79:1, 87, 113, 128, 143, 148, 154, 158, 165, 165:1, 165:2, 176, 183, 185, 197, 198, 201, 214, 224, 225, 257, 266, 267, 287, 354, 358, 365 and 368; and C. I. disperse green 6:1 and 9 are preferred, while not limitative.

Furthermore, these disperse dyes may be used solely or in combination of two or more kinds. The content of these dye (total content in the case of two or more kinds are used in combination) is in a range of 0.1 to 25 wt. %, preferably 0.5 to 20 wt. %, and more preferably 1 to 15 wt. %. If the content of the disperse dye is less than 0.1 wt. %, density of color development becomes insufficient. On the other hand, when the content of the disperse dye exceeds 25 wt. %, degradation of storage stability of the ink or failure of ejection due to increasing of viscosity or separation out associated with evaporation of ink in the vicinity of the tip end of the ejection ports can be caused. Also, as compound to disperse the disperse dye in a water based medium of the ink to be used in the present invention, dispersing agent, surface active agent, resin and so forth can be employed. As the dispersing agent or surfactant agent, any one of anion type and nonion type may be used. Anion type agent may be selected from the group consisting of fatty acid salt, alkylsulfuric ester, alkyl benzene sulfonate, alkylnaphthalenesulfonate, dialkyl sulfosuccinate, alkyl phosphoric acid ester, naphthalenesulfonate formaldehyde condensate polyoxyethylene alkylsulfuric ester, and substitutional derivative thereof. Nonion type agent may be selected from the group consisting of polyoxyethylene alkylether, polyoxyethylene alkylphenylether, polyoxyethylene fatty acid ester, sorbitan fatty acid ester, polyoxysorbitan fatty acid ester, polyoxyethylene alkylamine, fatty acid ester of glycerin, oxyethylene propylene blockpolymer and substitutional derivative thereof.

As resin disperse agent, styrene and its derivative, vinylnaphthalene and its derivative, aliphatic alcohol ester of $\alpha$, $\beta$-unsaturated carboxylic acid or so forth, acrylic acid and its derivative, maleic acid and its derivative, itaconic acid and its derivative, fumaric acid and its derivative, vinyl acetate, vinyl alcohol, vinyl pyrrolidone, acrylamide and block copolymer, random copolymer and graft copolymer consisted of two or more monomer selected from derivatives (amongst, at least one is hydrophilic monomer) and salt thereof. This resin is preferably alkali-soluble type resin soluble to an aqueous solution containing base.

On the other hand, the ink to be used in the present invention contains water as primary component in the content of 10 to 93 wt. %, preferably 25 to 87 wt. % and more preferably 30 to 82 wt. %.

The effect of the present invention will become more remarkable by employing water soluble organic solvent. The solvent may be selected among monohydric alcohols such as methanol, ethanol, isopropyl alcohol and so forth; ketone or ketols such as acetone, diacetone alcohol and so forth; ethers such as tetrahydrofuran, dioxane, and so forth; addition polymer of oxyethylene or oxypropylene, such as diethylene glycol, triethylene glycol, tetraethylene glycol, dipropylene glycol, tripropylene glycol, polyethylene glycol, polypropylene glycol and so forth, alkylene glycols including alkylene group having 2 to 6 carbon atoms, such as ethylene glycol, propylene glycol, trimethylene glycol, butylene glycol, hexylene glycol and so forth, triols such as 1,2,6-hexatriol or so forth; thiodiglycol; bis-hydroxyethylsulfon; glycerine; lower alkyl ethers of polyhdroxy alcohol such as ethylene glycol monomethyl ether, ethylene glycol monoethyl ether, diethylene glycol, monoethyl ether, diethylene glycol monomethyl ether, triethylene glycol ether, triethylene glycol monoether ether, or so forth; lower dialkyl ethers of polyhydroxy alcohol such as triethylene glycol dimethyl ether, triethylene glycol diethyl ether, tetraetlene glycol dimethyl ether, tetraetlene glycol diethyl ether and so forth, suforan, N-methyl-2-pyrrolidone, 2-pyrolidone, 1,3-dimethyl-2-imidazolidinone or so forth. The content of the water soluble organic solvent is generally in a range of 0 to 50 wt. %, and preferably in a range of 2 to 45 wt. %.

When the foregoing media are used in combination, it can be used as a mixture even if it is solely used. However, the most preferable composition of the liquid medium contains the solvent containing at least one kind of monohydroxy or polyhydroxy alcohol and its derivatives. Amongst, thiodigylcol, bis-hydroxyehyl sulfon, diethylene glycol, triethylene glycol, triethylene glycol monomethyl ether, tetraethylene glycol dimethyl ether, ethanol are particularly preferred.

The major components of the ink to be used in the textile printing method in accordance with the present invention are as set forth above. However, various dispersing agent, surfactant agent, surface tension adjusting agent, fluorescent bleach and so forth may be added as required.

Also, as metallic complex salt dye, acid milling yellow-MR, acid milling cyanine 5R, acid fast cyanine G, acid milling black TLB, acid blue-black 10B, metallized yellow G, metallized brilliant blue G, metallized brown RR, metallized black BGL, metallized black GL are preferred. However, the foregoing list is not exhaustive.

On the other hand, while not limitative, non-organic pigment such as ultra marine, titanium oxide, tenal blue and so forth, or organic pigment such as diazo yellow, disazo orange, permanent carmine FB, phthalocyanine blue, phthalocyanine green, thioindigo violet, dioxazine violet, are preferred.

Hereinafter, discussion will be given for several embodiments of the present invention in the apparatus set forth above.

(First Embodiment)

Figure 5:
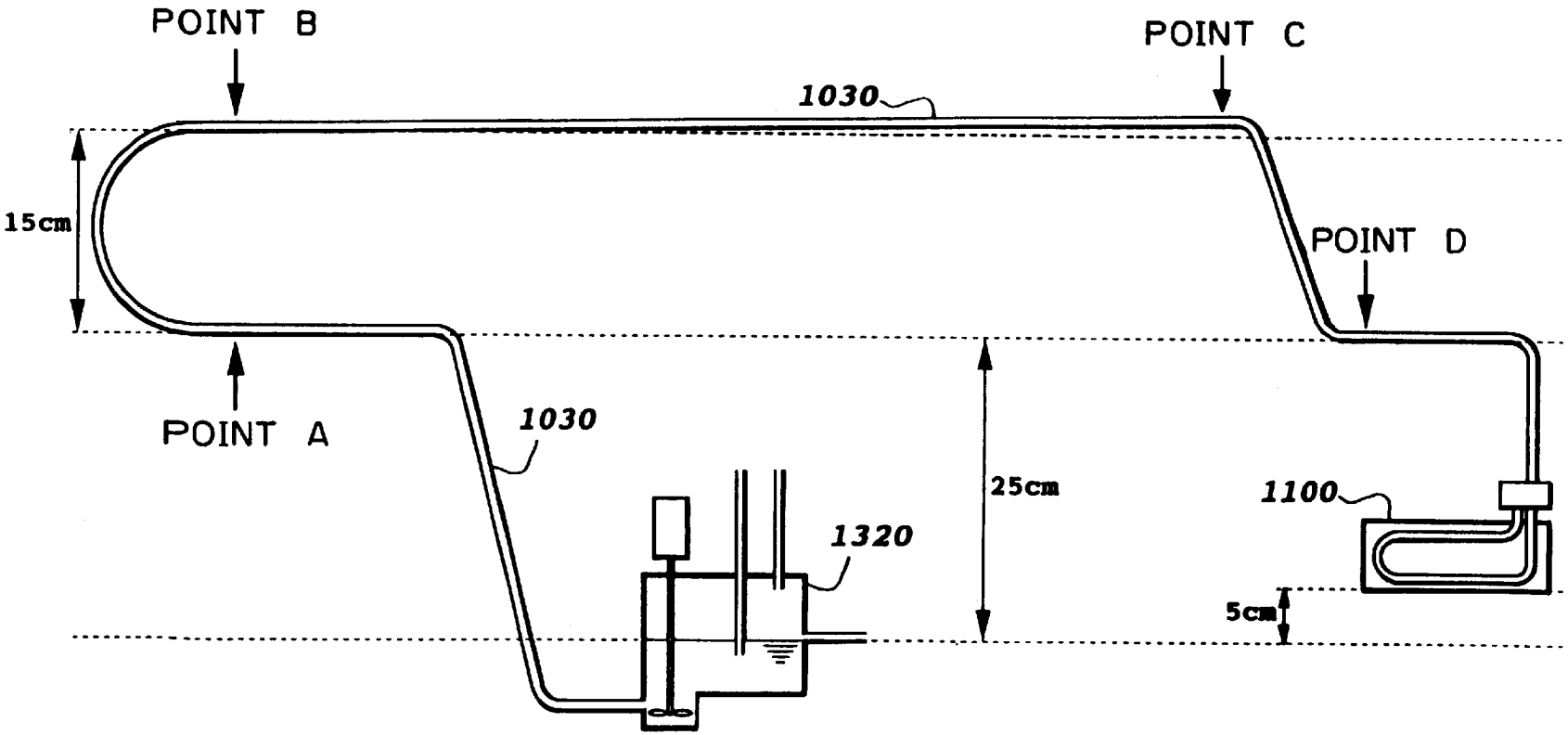
FIG. 5 is a diagrammatic view showing a positional relationship of a supply side passage of the ink supply passage of one embodiment according to the invention.

FIG. 5 is a diagrammatic view showing positional construction of the ink supply passage 1030 between the subtank 1320 to the printing head 1100.

The ink supply passage 1030 has large height difference between points A and B and between points C and D, as shown, and has a small height difference between the points B and C having relative long distance, in which the point C is slightly higher than the point B. As the ink supply passage, a polyolefin type tube as the ink supply passage having 6 m of overall length, 5 mm of inner diameter and 8 mm of outer diameter was employed. On the other hand, the ink having the following composition was prepared. Preparation of Disperse dye liquid (I–II)

| | |
|---|---|
| β-naphthalene sulfone acid formaldehyde condensate | 20 parts |
| ion-exchanged water | 55 parts |
| diethylene glycol | 10 parts |

The foregoing components were mixed to obtain a solution, the following disperse dye 15 parts were newly added to the solution, and then the solution was subjected to pre-mix for 30 min. Thereafter, dispersing process was performed in the following condition.

Disperse Dye

C. I. disperse yellow 198 (for Disperse dye liquid I)

C. I. disperse blue 79 (for Disperse dye liquid II)

dispersing machine: sand grinder (Igarashi Kikai)

crushing medium: zirconium bead 1 mm diameter crushing medium filling rate: 50% by volume Revolution speed: 1500 r.p.m.

crushing period: 3 hours

Furthermore, by filtering with floropore-filter FP-250 (tradename: Sumitomo Denko) to remove coarse particles to obtain disperse dye liquids I to IV.

| Preparation of Inks | |
|---|---|
| foregoing disperse dye liquid (I) | 10 parts |
| foregoing disperse dye liquid (II) | 30 parts |
| thiodiglycol | 24 parts |
| diethylene glycol | 11 parts |
| sodium bisilicate | 0.0005 parts |
| ferrous sulfate | 0.001 parts |
| nickel chloride | 0.0003 parts |
| zinc sulfate | 0.0003 parts |
| calsium chloride | 0.002 parts |
| ion exchanged water | 25 parts |

The foregoing components are mixed. The mixture solution is adjusted by sodium hydrate at pH 8. After stirring for 2 hours, filtering is performed with floropore filter FP-100 (tradename: Sumitomo Denko) to obtain an ink.

Here, one point B at the supply side of the ink supply passage 1030 is provided with a portion projecting in the vertical direction as discussed later. By this, it becomes possible to avoid increasing of density difference in the portion having position difference in the vertical direction (height difference). Namely, by the projecting portion, movement of the ink caused by difference of specific gravity can be controlled on non-printing.

Figure 6:
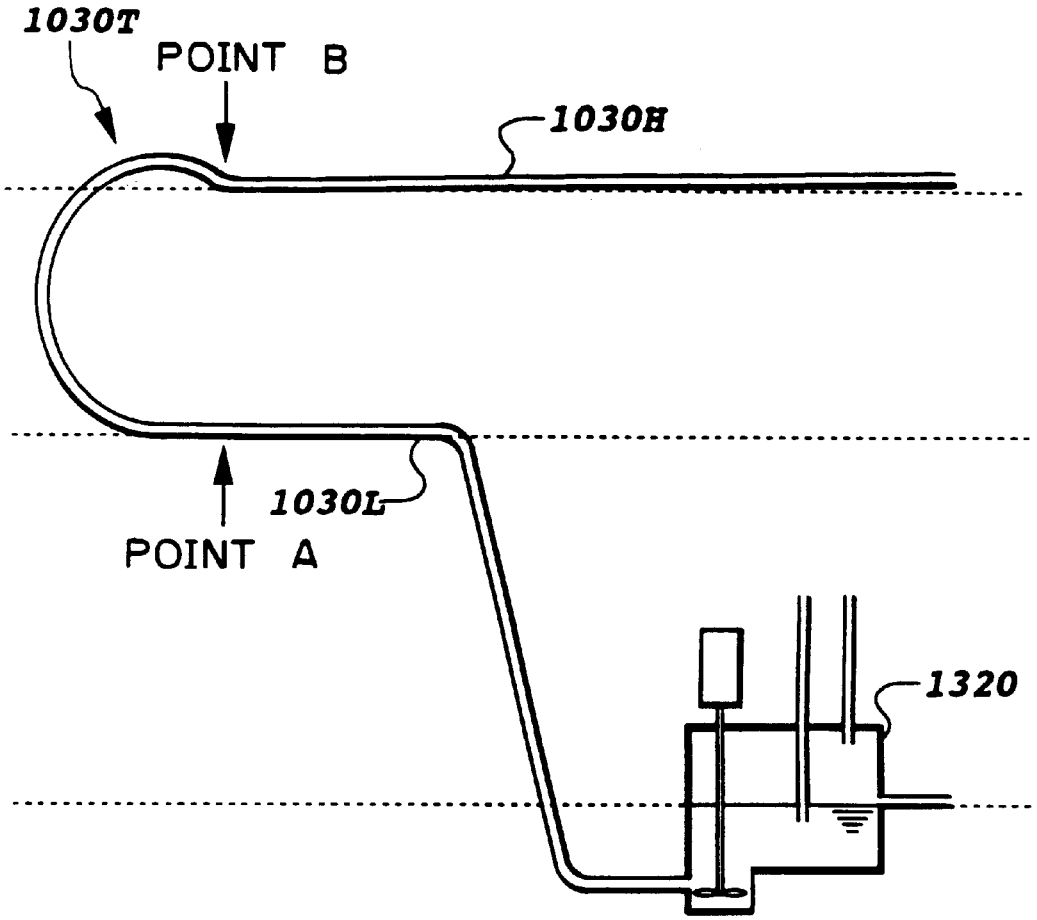
FIG. 6 is a diagrammatic view showing the configuration of a tube in the first embodiment of the present invention.
Figure 7:
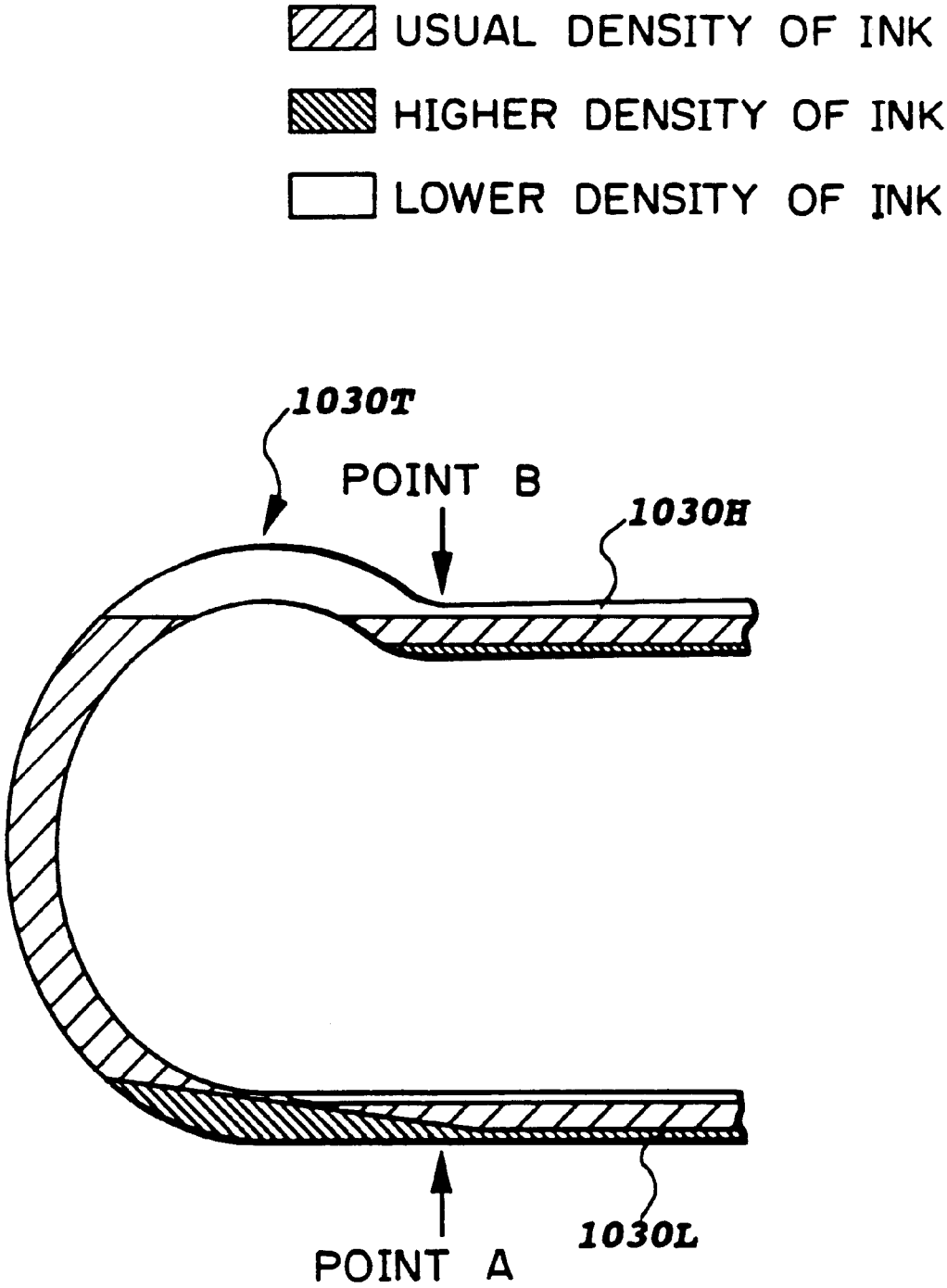
FIG. 7 is a conceptual view for explaining fluctuation of density of ink in the tube as shown in FIG. 6.

FIG. 6 is a diagrammatical view showing a detail of the ink supply passage 1030, in which the projecting portion is provided at the point B, and FIG. 7 is a conceptual view showing the effect of the projecting portion.

Namely, in FIG. 6, the projecting portion is a portion which has precipitously varying vertical position (height difference) in the tube construction. Between the points A and B, the tube at the point B being higher than at the point A, is bent in convex form. The configuration of the convex form is to increase the height for 5 cm in the length of 30 cm of the ink passage.

With the construction of the ink supply passage, as shown in FIG. 7, difference of specific gravity is caused in the ink in the supply passage 1030H which is a vertical high portion in the ink supply passage 1030, and if the portion of the ink having high gravity tends to vertically flow down from the point B to the point A due to difference of specific gravity. However, due to presence of the convex form portion 1030T, flow of the high gravity portion of the ink down to the point A can be restricted. As a result, movement of the ink is caused only in the ink located between the point A and B. Therefore, fluctuation of the ink density can be minimized.

It should be noted that, in the present embodiment, the convex form can be easily realized by varying the configuration of a caterpillar bundling the tubes 1030.

The apparatus having the ink supply passage having the construction set forth above are left in the resting condition for one week. After leaving, the inks in the points A and B and ink well stirred by the ink stirring member 320 in the main tank were sampled by syringe. The sampled ink is diluted for 5000 times (100 times by water, 50 times by diluting liquid (composition of diluting liquid: ethanol 75 parts, water 22 parts, phthalic acid buffer solution 2.5 parts). Absorptivities of the diluted ink were measured with HITACHI, U-330 Spectrophtometer and compared as follows. The ratio of absorptivity of the inks at respective points relative to absorptivity of the ink in the main tank are as follows. It should be noted that the absorptivity is the absorptivity in the maximum absorption wavelength.

| | |
|---|---|
| Point A | 1.29 |
| Point B | 0.93 |

(Second Embodiment)

Figure 9:
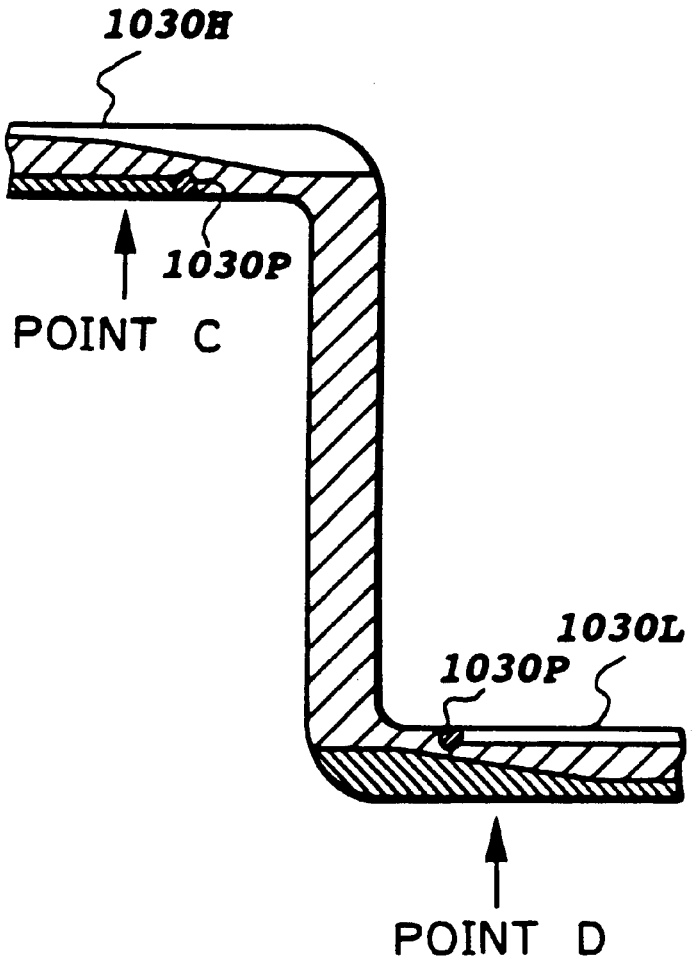
FIG. 9 is a conceptual view for explaining fluctuation of density of ink in the tube as shown in FIG. 8A.

FIGS. 8A–8C are a diagrammatical view and enlargements thereof for explaining the convex portion provided in the second embodiment of the ink supply passage 1030 of the present invention, and FIG. 9 is a diagrammatical view showing the effect thereof.

Here, employing the ink-jet textile printing apparatus set forth above, the projection 1030P is provided on the lower surface in the ink supply portion at the portion at relatively high position in vertical direction (point C), in the ink supply passage, and on the upper surface side in the relative low portion (point D). For the portion having position difference in the vertical direction (height difference), increasing of the difference of density to be caused by local movement of the ink due to difference of specific gravity can be prevented. The construction of the projection 1030P is preferred to have the height in the vertical direction greater than or equal to 1/20 times or smaller than or equal to 1/10 times of inner diameter in the ink supply passage, and more preferably greater than or equal to 1/6 times and smaller than or equal to 1/3 times.

In the present embodiment, the projection 1030P in the height of 1 mm is provided inside of the tube. Namely, between the points C and D where position difference (height difference) is caused abruptly in the vertical direction, the upward projection 1030P is formed in the inner lower surface of tube at the point C and the projection 1030P is formed on the inner upper surface of the tube at the point D. In addition, a step is provided in the passage from the printing head 1100 to the high portion of the tube 1030H in order to reduce the length between the points C and D where abrupt position difference in the vertical direction is present and, thus density fluctuation can be caused. By providing the projections 1030P, movement of the ink (for textile printing) due to difference of specific gravity can be restricted to prevent increasing of the density difference.

The apparatus having the ink supply passage having the construction set forth above are left in the resting condition for one week. After leaving, the inks in the points C and D and well stirred by the ink stirring member 320 ink in the main tank were sampled by syringe. Then absorptivities of the sampled inks were measured in the similar manner to the foregoing first embodiment and the ratios were derived. The ratio of absorptivity of the inks at respective points relative to absorptivity of the ink in the main tank are as follows.

| | |
|---|---|
| Point C | 0.92 |
| Point D | 1.12 |

Figure 10A:
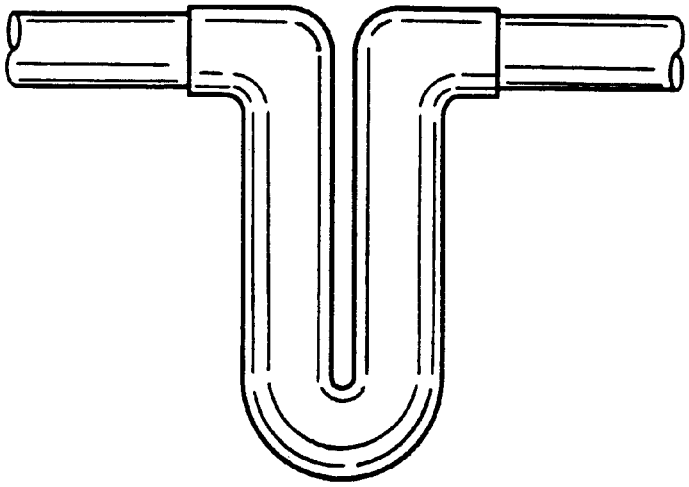
FIGS. 10A to 10C are diagrammatic views showing one modification of constructions of tubes as shown in FIG. 8A.
Figure 10B:
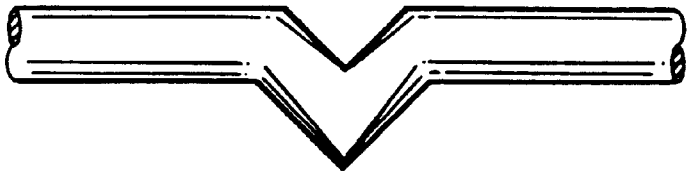
Figure 10C:
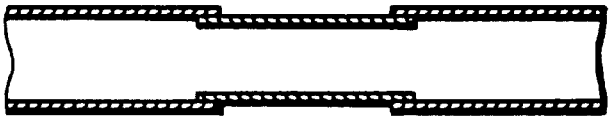

In place of the projection as employed in the present embodiment, it may have a by-pass (FIG. 10A), deform the tube into convex form (FIG. 10B) or have a different diameter portion in the tube (FIG. 10C). Also, similarly to the foregoing first embodiment, it is possible to form convex form by modifying arrangement of the tube.

By taking the arrangement of the tube of the present embodiment, even when the dye density is high and thus the specific gravity is large, movement of the portion having lower density and smaller specific gravity can be restricted with a predetermined region. Furthermore, since a region, in which movement of the ink is potentially caused, is made as small as possible, density fluctuation in the portion having abrupt variation of the position in the vertical direction can be minimized.

(Third Embodiment)

In this embodiment, employing the ink-jet textile printing apparatus as set forth above, a plurality of convex portions 1030T are sequentially formed in a part or whole of the ink supply passage. Such construction is particularly effective for preventing increasing of the density difference to be caused by movement of the ink depending upon local difference of the specific gravity of the ink, for the portion where the difference of position in the vertical direction (height difference) is small but the length of the portion is long. The construction of each of series of convex portions projecting in vertical direction is to have the vertical height in a range greater than or equal to 1/10 and smaller than or equal to 20 times of the inner diameter of the ink supply passage, and more preferably in a range of 1/3 and smaller than or equal to 6 times of the inner diameter of the ink supply passage. Also, the preferred interval of the convex portions is in a range greater than or equal to 5 times and smaller than or equal to 100 times of the inner diameter f the ink supply passage, and more preferably in a range of greater than or equal to 20 times and smaller than or equal to 60 times.

Figures 11A, 11B:
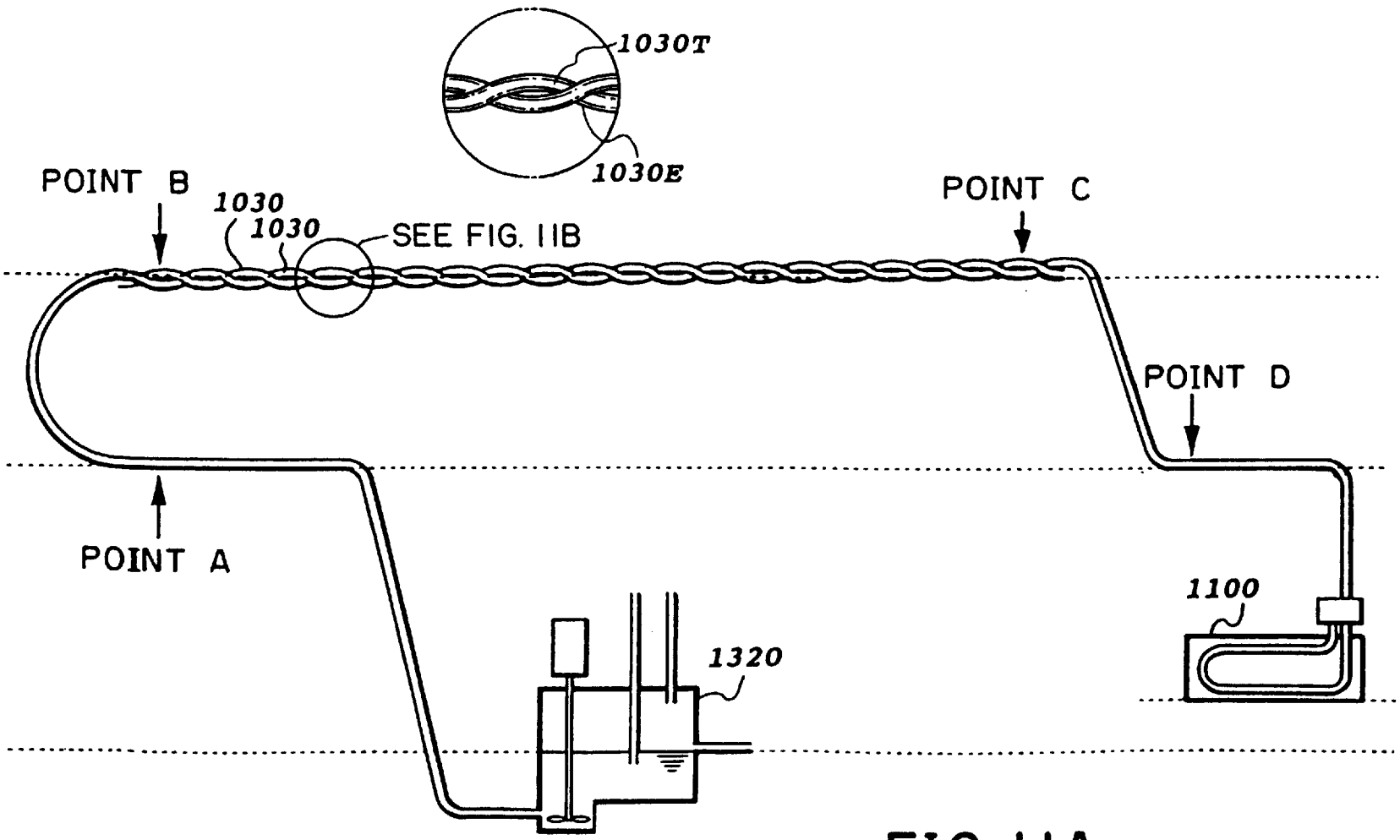
FIGS. 11A and 11B are a diagrammatic view and an enlargement thereof showing arrangement and construction of the tube according to the third embodiment of the invention.

As shown in FIGS. 11A and 11B, the present embodiment forms a plurality of series of convex portions by twisting the tube 1030E having the similar construction as other ink supply passage over the portion of the tube between points B and C which is extended long length with relatively small position difference in the construction of the tube.

It should be noted that, in the present construction, the magnitude of height difference in the longitudinal direction as the height of the convex portion is 8 mm which is 1.6 times of the inner diameter of the ink supply passage, and the interval of the series of convex portions is 17 cm which is 34 times of the inner diameter.

The apparatus having the ink supply passage having the construction set forth above are left in the resting condition for one week. After leaving, the inks in the points B and C and ink well stirred by the ink stirring member 320 in the main tank were sampled by syringe. Then absorptivities of the sampled inks were measured in the similar manner to the foregoing first embodiment and the ratios were derived. The ratio of absorptivity of the inks at respective points relative to absorptivity of the ink in the main tank are as follows.

| | |
|---|---|
| Point B | 0.97 |
| Point C | 0.96 |

Figure 12A:
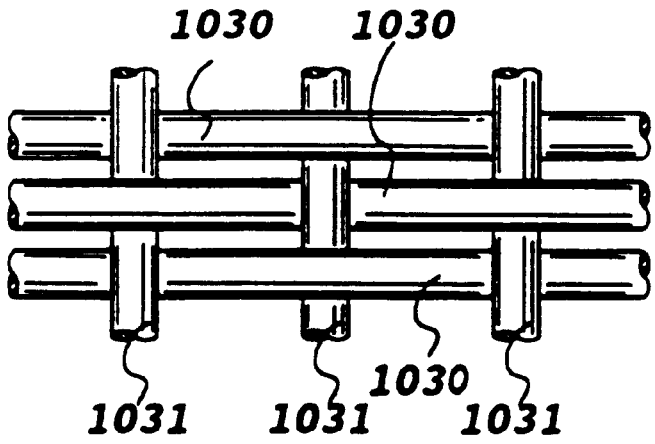
FIGS. 12A and 12B are diagrammatic views showing one modification of arrangement and constructions of tubes as shown in FIG. 11A.
Figure 12B:
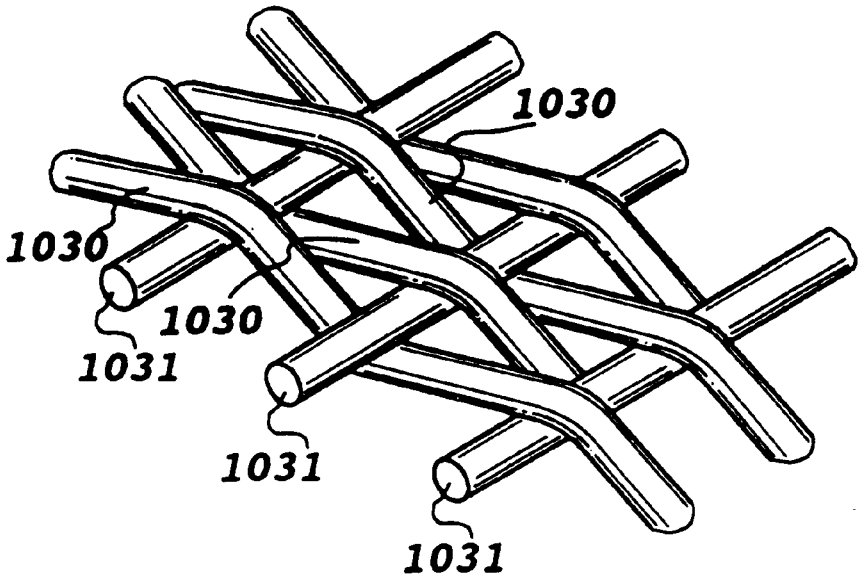

Other than the present embodiment, when the series of convex portions are formed in a plurality of ink supply passages in the same positional construction, as shown in FIGS. 12A and 12B, the tubes 1030 are arranged in parallel in the horizontal direction. Then, bar-shaped members 1031 are arranged on planes parallel to the plane on which the tubes are arranged and perpendicular to the extending direction of the tubes so as to pass the upper and lower sides of the tubes alternately to form the convex portions at crossing portions of such a matrix.

With taking this construction, even in the case where a plurality of kinds of ink supply passages are formed in the same constriction as the present embodiment, the similar effect to the present embodiment can be attained without causing significant increase of the space.

Figure 13:
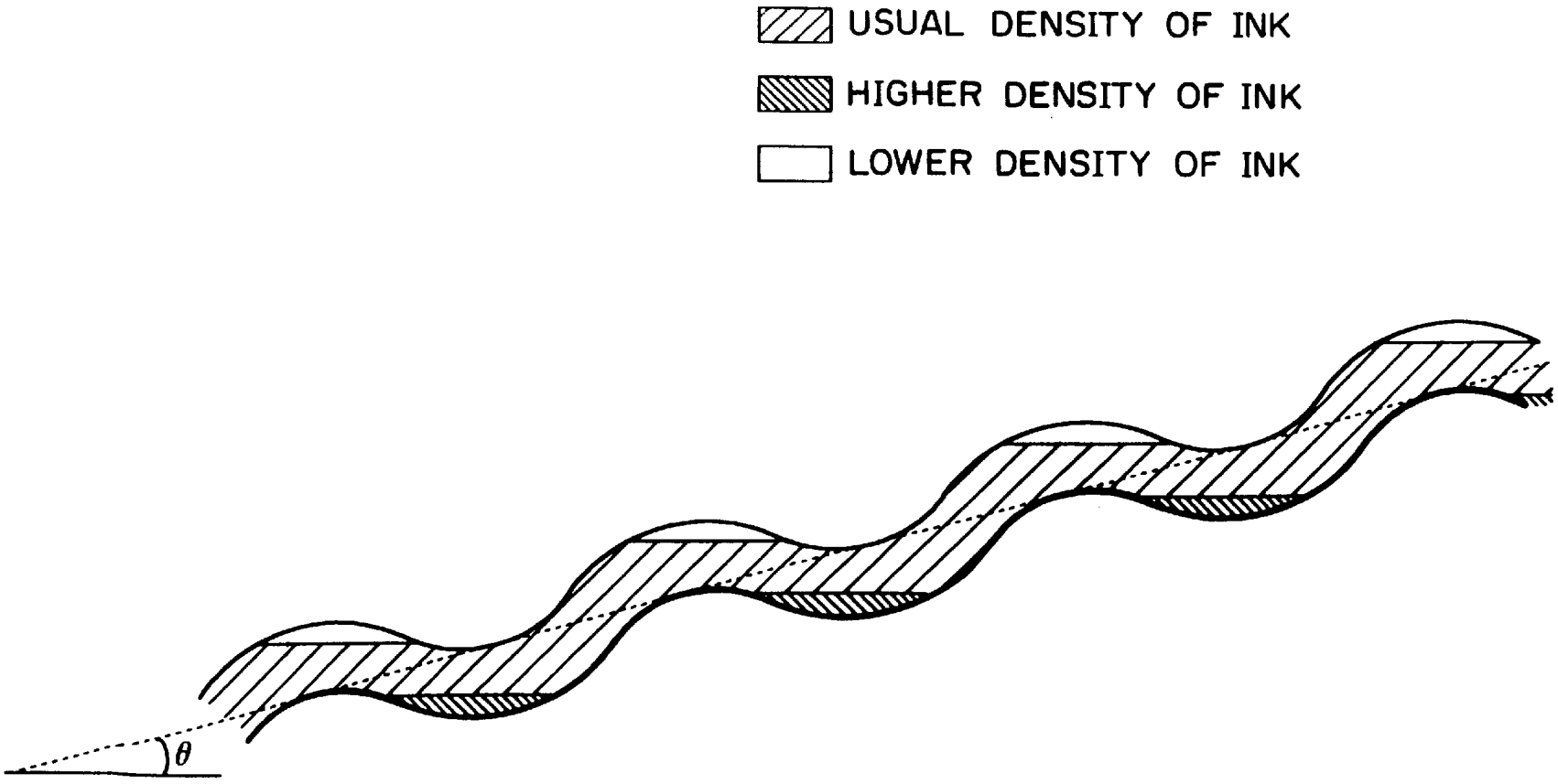
FIG. 13 is a conceptual view for explaining fluctuation of density of ink in the tube as shown in FIG. 11A.

With taking the arrangement of the tube shown in the present embodiment, it becomes possible to restrict movement of the ink due to local difference of the specific gravity within the predetermined region as shown in FIG. 13. Thus, even in the ink supply passage having long passage length, occurrence of large density fluctuation can be suppressed. Although the ink supply passage cannot be taken completely horizontal positional construction, in the ink supply passage with a little height difference, increasing of the density difference can be effectively prevented.

On the other hand, it may divide the ink supply passage into passages of smaller diameter and to twist the smaller diameter passages as shown in the embodiment. With taking this construction, the flow passage resistance in the passage becomes higher to make movement of the ink difficult and thus to prevent increasing of density fluctuation.

Furthermore, it may provide electromagnetic valve or check valve as control means in the ink supply passage to close the supply passage while not printing.

On the other hand, when the non-printing state is maintained for a long period, it may prevent occurrence of density fluctuation by circulating the ink in the ink supply passage per every given period.

It should be noted that, in each embodiment, while only configuration of the ink supply passage has been explained, it may provide the construction for preventing movement of the ink in the ink passage in the printing head or in the ink storage passage being wide in the horizontal direction.

Comparative Example

Here, the main body of the apparatus employing the ink-jet textile printing apparatus shown in the first embodiment with the ink supply passage having the positional construction shown in FIG. 5 without having the construction for restricting movement of the ink as shown in respective embodiments, the apparatus is left in non-printing state for one week. After leaving in non-printing state, the ink at the points A, B, C and D and the ink well stirred by the ink stirring member 320 ink in the main tank are sampled by syringe. Then, similarly to the first embodiment, absorptivities of the inks are measured and the ratio of the absorptivity of the ink at respective points relative to the absorptivity of the ink in the main tank. The results are shown as follows.

| | |
|---|---|
| Point A | 1.62 |
| Point B | 0.75 |
| Point C | 0.65 |
| Point D | 1.42 |

Figure 14A:
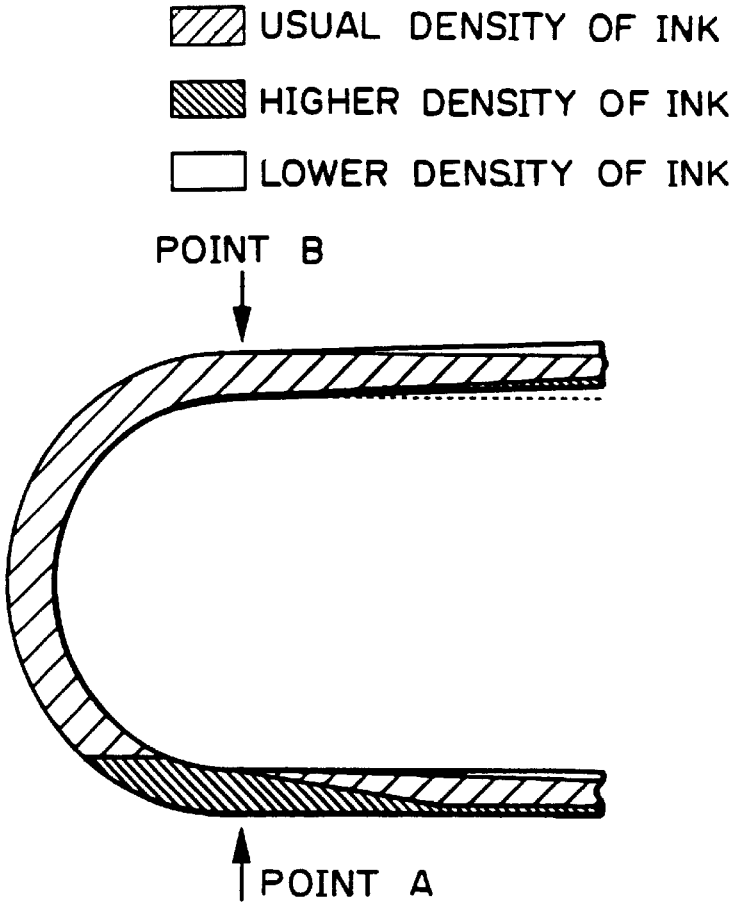
FIGS. 14A and 14B are conceptual views for explaining fluctuation of density of ink in tubes of the respective comparative examples.
Figure 14B:
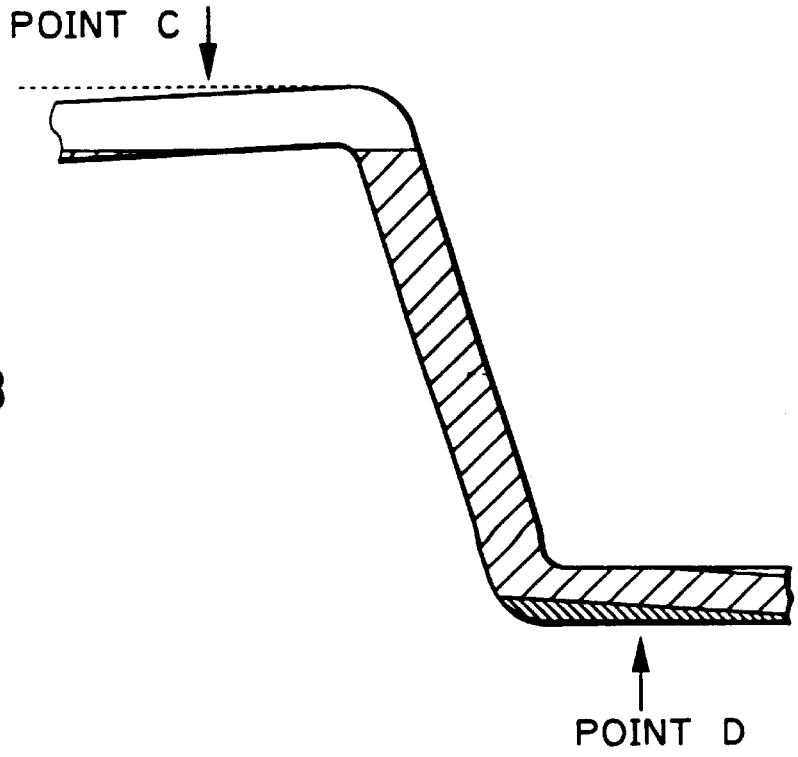

FIGS. 14A and 14B are diagrammatical views showing increasing of the density difference between the points A and B and between the points C and D in the comparative example. As seen from FIGS. 14A and 14B, since movement of the ink due to difference of the specific gravity cannot be prevented, large ink movement is caused to increase density difference.

Other Examples

In order to make the present invention more effective, the configuration of the ink storage tank can be formed into the configuration difficult to cause fluctuation of density. Namely, occupying area of the ink storage tank in the horizontal direction can be made smaller.

Figure 15A:
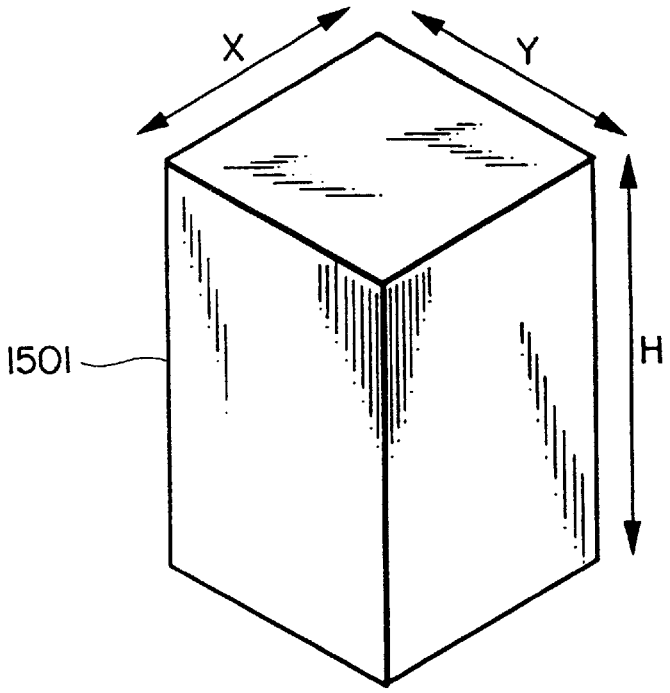
FIGS. 15A and 15B are views showing position and configuration of an ink storage tank of one embodiment of the present invention.
Figure 15B:
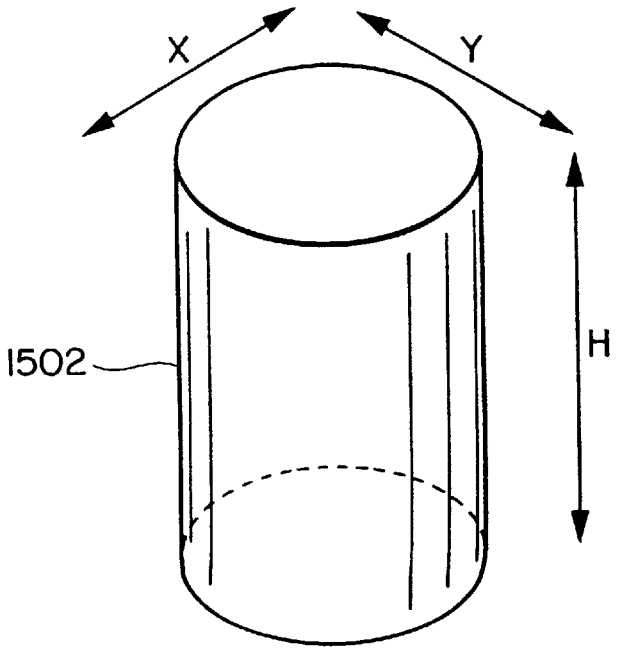
Figure 16A:
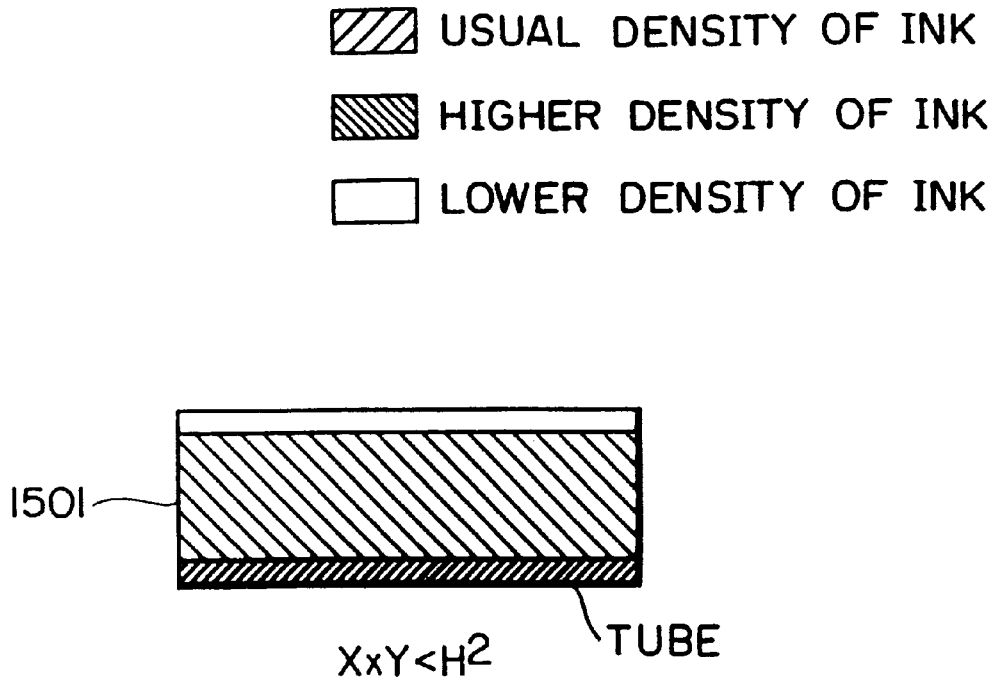
FIGS. 16A and 16B are conceptual views for explaining fluctuation of ink density depending upon configurations of ink storage tanks as shown in FIGS. 15A and 15B, respectively.
Figure 16B:
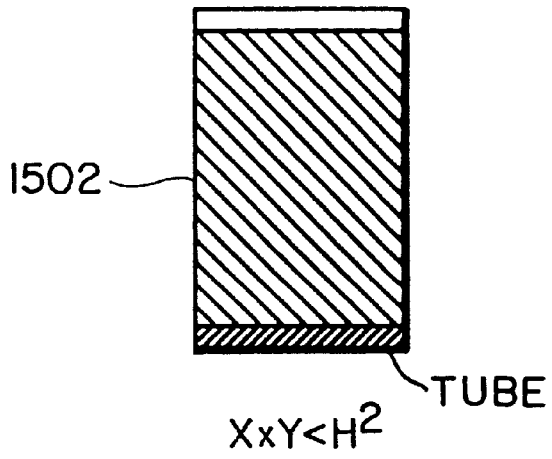

FIGS. 15A and 15B are perspective views showing two examples of the ink storage tanks suitable for shown embodiments. On the other hand, FIGS. 16A and 16B are diagrammatic illustration showing fluctuation of density of the ink in the tank shown in FIGS. 15A and 15B.

The configuration of the tank in the present embodiment can be expressed with depth X, lateral width Y and height H in the following equation.

$$X \times Y \leqq H^2$$

By employing the ink storage tank of the configuration in the present embodiment, the portion to cause fluctuation of the ink density can be made smaller to restrict significant fluctuation of density.

Namely, in the ink container or so forth, the construction having wide bottom (flat configuration having large horizontal area) is frequently employed. It has been experimentarily confirmed that such configuration easily causes settle out and thus causes density difference in comparison with the narrow configuration. Therefore, in order to satisfy the foregoing equation, fluctuation of density can be restricted by employing the configuration having narrow bottom.

It should be noted that the configuration to be expressed by the foregoing equation is not limited to the ink storage tank but can be employed in the portion in the ink supply passage where the given amount of ink is maintained, such as air buffer.

On the other hand, as the ink storage tank effective for the present embodiment, the following tanks may be listed.

(1) Stationary type tank not moved during printing:

As long as not intentionally moved, movement of the ink is not caused even in printing, and application of the present invention is effective.

(2) Tank directly storing the ink therein (not absorbing the ink in sponge or so forth):

In case of such type of ink tank, there are a few factors to block movement of the coloring agent. Therefore, application of the present invention is effective.

(3) Tank having large capacity greater than or equal to 1 liter:

In case of such large amount of ink, density difference is frequently caused. Therefore, application of the present invention is effective.

As can be clear from the foregoing explanation, according to the present invention, movement of the coloring agent of the ink in the ink supply passage between the ink storage portion and the ink ejection opening of the printing head can be controlled. Thus, even when difference of specific gravity is locally caused due to coagulation and settle out of the coloring agent of the ink, movement of the ink and the coloring agent can be restricted.

As a result, fluctuation of the printing density due to increasing of difference of the ink density during the resting state or so forth, can be prevented to allow high quality printing, constantly.

The present invention has been described in detail with respect to preferred embodiments, and it will now be understood that changes and modifications may be made without departing from the invention in its broader aspects, and it is the intention, therefore, in the appended claims to cover all such changes and modifications as fall within the true spirit of the invention.

What is claimed is:

1. An ink-jet printing apparatus for performing printing by ejecting an ink to a printing medium, comprising:

a printing head for ejecting the ink;

an ink storage portion for storing the ink;

an ink passage for effecting flow of the ink between said ink storage portion and said printing head, said ink passage comprising a first horizontal passage region, a second horizontal passage region and a connecting passage region connecting said first horizontal passage region with said second horizontal passage region, said first horizontal passage region being positioned lower than said second horizontal passage region; and limitation means for limiting movement of a coloring agent of the ink, said limitation means being provided in said second horizontal passage region, wherein said limitation means is formed of a plurality of vertically convex-shaped convex portions formed in series in a part of said second horizontal passage region.

2. An ink-jet printing apparatus as claimed in claim 1, wherein said ink is a water-based ink containing a water insoluble coloring agent or a coloring agent having low water solubility dispersed therein.

3. An ink-jet printing apparatus as claimed in claim 1, wherein said limitation means limits the movement of the coloring agent from said printing head to said ink storage portion while the ink is stopped from flowing within said ink passage from said ink storage portion to said printing head.

* * * * *

UNITED STATES PATENT AND TRADEMARK OFFICE

CERTIFICATE OF CORRECTION

PATENT NO. : 6,183,074 B1
DATED : February 6, 2001
INVENTOR(S) : Miyashita et al.

It is certified that error appears in the above-identified patent and that said Letters Patent is hereby corrected as shown below:

Column 1,
Line 4, "Sep. 15, 1996" should read -- Apr. 15, 1996 --.

Column 7,
Line 4, "Upon non" should read -- When not --.

Column 10,
Line 16, "calsium chloride" should read -- calcium chloride --.
Line 66, "Spetrophtometer" should read -- Spectrophotometer --.

Column 14,
Line 4, "illustration" should read -- illustrations --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*